United States Patent [19]

Tanaka et al.

[11] 4,267,233

[45] May 12, 1981

[54] ELECTRICALLY CONDUCTIVE FIBER AND METHOD FOR PRODUCING THE SAME

[75] Inventors: Hiroaki Tanaka; Kiyokazu Tsunawaki, both of Matsuyama, Japan

[73] Assignee: Teijin Limited, Osaka, Japan

[21] Appl. No.: 119,019

[22] Filed: Feb. 6, 1980

[30] Foreign Application Priority Data

| | | | |
|---|---|---|---|
| Feb. 14, 1979 | [JP] | Japan | 54-15035 |
| May 1, 1979 | [JP] | Japan | 54-52465 |
| May 8, 1979 | [JP] | Japan | 54-55229 |

[51] Int. Cl.[3] ..... B32B 9/00

[52] U.S. Cl. ..... 428/389; 57/901; 427/58; 427/400; 428/253; 428/263; 428/392; 428/394; 428/395

[58] Field of Search ..... 427/58, 400; 428/375, 428/392, 263, 394, 395, 922, 253, 254, 389; 57/901

[56] References Cited

U.S. PATENT DOCUMENTS

| | | | |
|---|---|---|---|
| 3,817,784 | 6/1974 | Cairncross et al. | 427/58 |
| 3,983,286 | 9/1976 | Arsac | 428/389 |

FOREIGN PATENT DOCUMENTS 51-68839 6/1976 Japan

*Primary Examiner*—James J. Bell

*Attorney, Agent, or Firm*—Burgess, Ryan and Wayne

[57] ABSTRACT

An electrically conductive fiber having an electric resistivity of $1 \times 10^{12}$ ohm/cm or less under a D.C. voltage of 1 K.V., contains copper (I) iodide which has been deposited in the inside of at least the peripheral surface layer of an electrically non-conductive fiber matrix by contacting iodine with copper (I) ions therein.

12 Claims, 2 Drawing Figures

ELECTRICALLY CONDUCTIVE FIBER AND METHOD FOR PRODUCING THE SAME

FIELD OF THE INVENTION

The present invention relates to an electrically conductive fiber and a method for producing the same. More particularly, the present invention relates to a modified natural or artificial fiber having a proper electric conductivity and a method for producing the same.

The term "fiber" used herein refers to continuous filaments and staple fibers. The fiber may be in any form of fiber mass, for example, multifilament yarn, monofilament yarn, spun yarn, split yarn, cord, thread, rope, woven, knitted or non-woven fabric, net, carpet or blanket.

BACKGROUND OF THE INVENTION

It is known that artificial fibers, for example, polyester fibers, polyamide fibers, polyacrylic fibers and cellulose acetate fibers, exhibit a very poor electric conductivity and one highly hydrophobic. Therefore, when an artificial fiber mass is rubbed, static electricity is generated and accumulates on the fibers. Sometimes, the voltage of accumulated static electricity reaches a very high level of several kilovolts. This phenomenon results in various annoyances, that is, items of apparel cling to the body and are attracted to other garments; fine particles of lint and dust are attracted to a fabric; the frequency of required cleaning is increased; and a jolt or shock is experienced upon touching a metallic article after walking across a carpet. Also, the above-mentioned accumulation of static electricity on the fiber mass is dangerous that is, the discharge of static electricity result in a spark capable of igniting flammable mixtures, such as an ether-air mixture, which are commonly found in hospitals, especially in operating rooms.

It is also known that natural fibers, such as animal hairs and silk, exhibit a relatively high hydrophilic property and this property causes the natural fibers to exhibit a relatively high electric conductivity at a relatively high humidity due to a relatively high content of moisture absorbed in the natural fibers. This moisture content can avoid the above-mentioned annoyance and danger which is derived from the accumulation of static electricity. However, when the natural fibers are placed in an atmosphere of low humidity, static electricity will build up on the fibers, so as to cause the above-mentioned annoyance and danger.

The most effective manner for preventing the above-mentioned undesirable phenomena is to utilize fibers having a high electrical conductivity. For this purpose, metallic fibers, fibers plated with a metal, fibers containing therein carbon black as an electrically conductive material (U.S. Pat. Nos. 3,803,453, 3,969,559 and 4,045,949) and fibers coated with a polymeric dope containing an electrically conductive material (British Pat. Nos. 1,259,315 and 1,391,262) are known as electrically conductive fibers.

However, conventional electrically conductive fibers are not necessarily satisfactory for practical use. For example, metallic fibers exhibit a very poor recovery from bending and are easily broken when processed or used. The breakage results in a decrease in the conductive effect of the metallic fiber. Also, it is difficult to mix spin, mix weave or mix knit the metallic fibers with organic polymer fibers. Further, the metallic fibers have a color which is sometimes undesirable for textile use.

In case of a fiber plated with a metal, it is required to form a uniform, continuous plated metal layer on the surface of the fiber. In order to satisfy the above-mentioned requirement, the surface of the fiber is required to be smooth.

Therefore, the metal plating operation can be applied only to limited types of fibers having a smooth surface.

In order to prepare a continuous layer of plated metal possessing a uniform thickness, it is necessary to carefully and accurately carry out the plating operation. The requirement causes the cost of the plating operation to be very high. Also, the metal-plated fiber is disadvantageous in that the plated metal layer is easily peeled off from the fiber during processing or use, and has a poor durability in use and a metallic color which is sometimes undesirable for textile use.

The fiber coated with a polymer dope containing an electrically conductive material, for example, carbon black and silver particles, is disadvantageous in that the coating operation is expensive and the coating layer is easily peeled off from the fiber during processing or use.

In order to provide the fiber containing therein carbon black as an electrically conductive material and having a proper conductivity, it is necessary that the carbon black is contained in a large amount of at least 15% based on the weight of the fiber matrix polymer. This large amount of carbon black causes the fiber-producing process to be difficult, complex and expensive. Also, it is impossible to contain the carbon black in the inside of the natural fibers. Furthermore, the carbon black-containing fiber has a gray or black color which is sometimes undesirable for textile use.

SUMMARY OF THE INVENTION

An object of the present invention is to provide an electrically conductive fiber which exhibits a proper conductivity and substantially no color, or a very slight color, and a method for producing the same.

Another object of the present invention is to provide an electrically conductive fiber which exhibits a permanent conductivity and which can be produced easily and at a low cost, and a method for producing the same.

The above-mentioned objects can be attained by the electrically conductive fiber of the present invention, which comprises an organic polymeric fiber matrix and copper (I) iodide which is located in the inside of at least the peripheral surface layer of said organic polymeric fiber matrix and which is in an amount sufficient to cause the electric resistivity of the conductive fiber under a D.C. voltage of 1 K.V. at a temperature of 20° C. at a relative humidity of 65% to be $1\times10^{12}$ ohm/cm or less. The aforementioned objects also can be attained by the method of the present invention for producing an electrically conductive fiber which comprises an organic polymeric fiber matrix and copper (I) iodide contained within at least the peripheral surface layer of said organic polymeric fiber matrix, and which exhibits an electric resistivity of $1\times10^{12}$ ohm/cm or less under a D.C. voltage of 1 K.V. at a temperature of 20° C. at a relative humidity of 65%, said method comprising bringing iodine into contact with copper (I) ions in the inside of at least the peripheral surface layer of said organic polymeric fiber matrix and depositing the resultant copper (I) iodide therein in an amount sufficient to result in the above-mentioned level of electric resistivity of the resultant conductive fiber.

Figure 1:
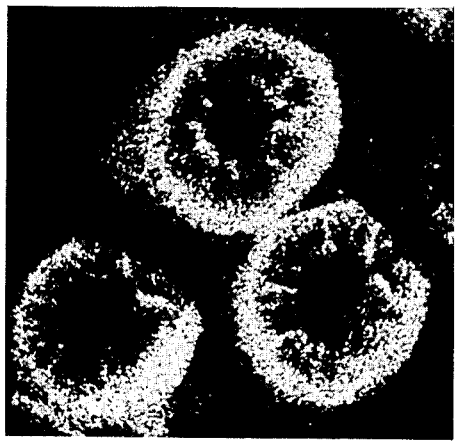
FIG. 1 is a microscopic photograph (X500) showing the distribution of copper (I) iodide particles in cross sections of conductive polyethylene terephthatate fibers of the present invention.
Figure 2:
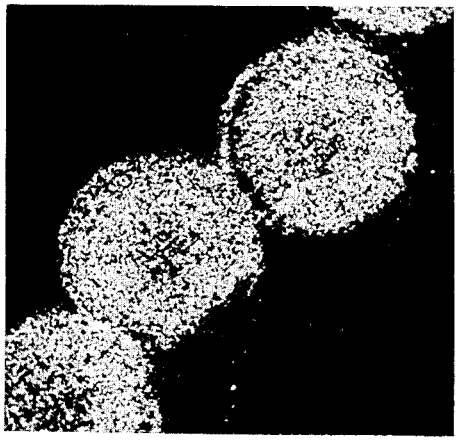
FIG. 2 is an electron microscopic photograph (X500) showing the distribution of copper (I) iodide particles in cross-sections of a conductive nylon 6 fibers of the present invention.

The photographs of FIGS. 1 and 2 were taken by using an X-ray microanalyzer.

DETAILED DESCRIPTION OF THE INVENTION

In the electrically conductive fiber of the present invention, the fiber matrix is selected from organic polymeric fibers, that is, artificial organic polymeric fibers and natural organic polymeric fibers.

The artificial organic polymeric fibers may include synthetic organic polymeric fibers and semi-synthetic organic polymeric fibers. The synthetic organic polymeric fibers may include polyester fibers, for example, polyethylene terephthalate fibers and polybutylene terephthalate fibers; aliphatic polyamide fibers, for example, nylon 6 and nylon 66 fibers; polyacrylic fibers, for example, polyacrylonitrile fibers and modacrylic fibers; vinyl compound polymer fibers, for example, polyvinylacetal fibers and polyvinyl chloride fibers; whole aromatic polyamide fibers, for example, poly-m-phenylene isophthalamide fibers and whole aromatic polyester fibers, for example, fibers made from a copolyester of terephthalic acid, isophthalic acid and hydroquinone. The semi-synthetic polymeric fibers may include cellulose diacetate fibers and cellulose triacetate fibers.

The natural organic polymeric fibers usable for the present invention may be selected from natural protein fibers such as animal hairs, for example, wool and silk.

In the electrically conductive fiber of the present invention, the copper (I) iodide in the form of small crystals is located in the inside of at least the peripheral surface of the organic polymeric fiber matrix. That is, the copper (I) iodide may be distributed either in the peripheral surface layer of fiber matrix only or in the entire body of the fiber matrix. In every case, the amount of the copper (I) iodide within the fiber matrix should be sufficient to cause the electric resistivity of the resultant conductive fiber under a D.C. voltage of 1 K.V. at a temperature of 20° C. and at a relative humidity of 65% to be $1\times10^{12}$ ohm/cm or less, preferably, $1\times10^{11}$ ohm/cm or less. This amount of copper (I) iodide is usually in a range of 2 to 250% based on the weight of the organic polymeric fiber matrix. The amount of copper (I) iodide to be contained in the fiber matrix is variable depending on the distribution of the copper (I) iodide. That is, when distributed only in the peripheral surface layer of the fiber matrix, for example, of polyester fiber matrix, the amount of copper (I) iodide may be in a range of from 2 to 110% based on the weight of the fiber matrix. In this case, it is preferable that the thickness of the peripheral surface layer of the fiber matrix in which the copper (I) iodide crystals are distributed is at least 0.05 microns, preferably, at least 0.1 microns. Also, when distributed in the entire body of the fiber matrix, for example, of an aliphatic polyamide, acrylic polymer, vinyl compound polymer, cellulose diacetate cellulose triacetate, wool or silk matrix, the amount of copper (I) iodide may be in a range of from 50 to 250% based on the weight of the fiber matrix. In each case, it is necessary that the crystals of copper (I) iodide contact at least one of the neighbouring crystals so as to form at least one continuous conductive system extending along the longitudinal axis of the fiber matrix in at least one portion of the fiber matrix.

This continuous conductive system causes the fiber to exhibit an electrical resistivity of $1\times10^{12}$ ohm/cm or less under a D.C. voltage of 1 kilovolt. An electrical resistivity larger than $1\times10^{12}$ ohm/cm will cause the fiber to be useless not only as an electrically conductive fiber, but also as an antistatic fiber.

The size of the crystals of the copper (I) iodide is not limited to a special range, as long as the resultant fiber can exhibit the above-mentioned level of electric fiber can exhibit the above-mentioned level of electric resistivity.

The electrically conductive fiber of the present invention can be produced by contacting iodine with copper (I) ions in the inside of at least a peripheral surface layer of the fiber matrix so as to allow the resulting copper (I) iodide to be deposited in the inside thereof. The thus deposited copper (I) iodide should be in an amount sufficient to produce the aforementioned level of electric resistivity of the resultant conductive fiber. The fiber matrix may be in any form of fiber structure, for example, individual monofilament, multifilament yarn, spun yarn, woven, knitted or non-woven fabric net or loose fiber mass. Also, the fiber matrix may have any type of cross-sectional profile, for example, circular, trilobal, another polylobal and the other non-circular profiles. Furthermore, the fiber matrix may be a hollow fiber or a composite fiber in which two or more constituents are incorporated in a side-by-side or core-in-sheath type arrangement into a body of fiber.

The contact of the iodine with the copper (I) ions can be effected by a process comprising the absorption of the iodine by at least the peripheral surface layer of the fiber matrix and, then, by contact of the iodine-absorbed fiber matrix with an aqueous solution containing a copper (I) compound.

Preferably, the above-mentioned absorption operation is carried out by bringing the organic polymeric fiber matrix into contact with an aqueous solution containing iodine and, preferably, an iodine-dissolving promoter. In this case, it is preferable that the aqueous solution contain iodine in an amount of from 10 to 1000 g more preferably, from 50 to 800 g, per liter of water. Usually, the iodine-dissolving promoter is selected from the group consisting of potassium iodide, sodium iodide, lithium iodide, ammonium iodide and hydrogen iodide and perferably used in an amount of from 0.03 to 3 mole per liter of water. Also, it is preferable that the absorption operation is carried out at a temperature of 0° to 100° C. The absorbing temperature is variable depending on the type of the fiber matrix used. For example, the preferable absorbing temperature is in the range of from 40° to 80° C. for polyester fibers, in the range of from 80° to 90° C. for whole aromatic polyamide fibers, in the range of from 10° to 30° C. for aliphatic polyamide fibers, polyacrylic fibers, vinyl compound polymer fibers, cellulose diacetate fibers, animal hair fibers and silk.

The iodine containing aqueous solution may contain an additive effective for swelling the fiber matrix. The swelling additive is effective for accelerating the absorption of iodine by the fiber matrix.

The absorption of iodine can be effected by using a solution of iodine in an organic solvent. Otherwise, the absorption of iodine can be effected by introducing the fiber matrix into an atmosphere containing iodine vapor.

In the type of absorption operation of iodine, it is necessary that the amount of the absorbed iodine in the fiber matrix is at least 2% based on the weight of the fiber matrix. However, the amount of the absorbed iodine is variable depending on the type and denier of the fiber matrix, the composition of the iodine-containing solution and the absorbing temperature and time. For example, in the case where nylon 6 fibers, each having a denier of 30, are immersed in an aqueous solution consisting of 60 parts by weight of iodine, 40 parts by weight of potassium iodide and 100 parts by weight of water, at room temperature for 10 minutes, the amount of the absorbed iodine reaches an equilibrium level of 190% based on the weight of the nylon 6 fibers. However, in the case where the same iodine aqueous solution as that mentioned above is applied to polyethylene terephthalate fibers, each having a denier of 30, in place of the nylon 6 fibers at a temperature of 80° C. for 2 hours, the iodine is absorbed in an amount of 40% based on the weight of the fiber.

In the method in which an iodine-absorbed fiber matrix is brought into contact with an aqueous solution containing a copper (I) compound, the copper (I) compound may be selected from the group consisting of copper (I) chloride, copper (I) bromide and copper (I) sulfite. The most perferable copper (I) compound is copper (I) chloride.

The contact of iodine with the copper (I) ions is effected preferably by immersing an iodine-absorbed fiber matrix in an aqueous solution of the copper (I) compound. The aqueous solution can be prepared by dissolving the copper (I) compound in water or by dissolving in water, simultaneously or in any order, a copper (II) compound and a reducing agent for converting the copper (II) compound to the corresponding copper (I) compound. Also, the aqueous solution can be obtained by dissolving the copper (I) compound together with the copper (II) compound and the reducing agent. The copper (II) compound may be selected from the group consisting of copper (II) sulfate, and copper (II) chloride.

The reducing agent may be selected from metallic copper, iron (I) salts and hydroxylamine sulfate. It is preferable that the copper (I) compound is dissolved in water in the presence of a dissolving promoter. For example, the dissolving promoter for copper (I) chloride may be selected from the group consisting of hydrochloric acid, ammonium chloride, sodium chloride and potissium chloride. The dissolving promoter is effective for increasing the solubility of the copper (I) compound and the concentration of copper (I) ions in the aqueous solution. The increased concentration of the copper (I) ions in the aqueous solution is effective for promoting the formation of copper (I) iodide in the fiber matrix.

It preferable that the aqueous solution of the copper (I) compound contains metallic copper preferably in the form of grains, preferably, thin wire or foil. The metallic copper is effective for maintaining the concentration of copper (I) ions in the solution constant during the treatment of the iodine-absorbed fiber matrix with the aqueous solution containing the copper (I) compound.

When the iodine-absorbed fiber matrix is immersed in an aqueous solution containing copper (I) ions, the reaction of iodine with the copper (I) ions can be developed by the diffusion of the copper (I) ions into the fiber matrix (I). Also, the reaction causes the concentration of the copper (I) ions in the aqueous solution to decrease. Therefore, in order to maintain a constant reaction rate while the copper (I) ions diffuse into the fiber matrix, it is necessary to maintain the concentration of copper (I) ions in the aqueous solution constant. In order to achieve this requirement, it is also necessary to continuously add an additional amount of the copper (I) compound to the aqueous solution.

However, when the above-mentioned immersion operation of the iodine absorbed fiber matrix and addition operation of the copper (I) compound are repeat several times by using the aqueous solution, the repeatedly used aqueous solution causes the resultant conductive fiber to be colored dark green and to exhibit a reduced degree of electric conductivity. In this case, the aqueous solution can no longer be utilized, and, therefore, must be replaced by fresh solution. This replacement results in a high cost in the production of the conductive fiber. Also, the used aqueous solution is biologically harmful and, therefore, should be converted into a harmless solution before discharging it from the conductive fiber-producing process. This conversion also results in an increased cost in the production of the conductive fiber.

The production of copper (I) iodide is effected in accordance with the following chemical equation:

$$I_2 + 4Cu^+ = 2CuI + 2Cu^{++}$$

That is, the production of copper (I) iodide is accompanied by the production of copper (II) ions as a by-product. The copper (II) ions cannot react with iodine and, therefore, are accumulated in the aqueous solution. This phenomenon results in a low efficiency in the production of the conductive fiber and in an undesirable coloration of the resultant conductive fiber.

The metallic copper placed in the copper (I) ion-containing aqueous solution is effective for reducing copper (II) ions to produce copper (I) ions.

$$Cu^{++} + Cu = 2Cu^+$$

Accordingly, the formation of copper (I) iodide in the presence of metallic copper is carried out in accordance with the following chemical equations:

$$\begin{array}{lll} I_2 & + 4Cu^+ & = 2CuI + 2Cu^{++} \\ +)\ 2Cu^{++} & + 2Cu & = 4Cu^+ \\ \hline I_2 & + 2Cu & = 2CuI \end{array}$$

That is, the amount of copper (I) ions which has been reacted with iodine can be supplied from the metallic copper. Accordingly, the metallic copper is remarkably effective not only for preventing the build up of copper (II) ions but also for maintaining the concentration of copper (I) ions in the aqueous solution thereof constant. This effect of the metallic copper makes it possible to repeatedly use the aqueous solution of the copper (I) compound, for example, 20 times or more, without adding an additional amount of the copper (I) compound and without replacing the solution with a fresh one.

The amount of the metallic copper to be placed in the copper (I) ion-containing aqueous solution is not limited to a specific range. That is, the amount of the metallic copper used is variable depending on the form and the surface area thereof. However, usually, the metallic copper is used in an amount corresponding to a surface area of at least 3 $cm^2$ per g/l of copper (I) ions in the aqueous solution. The metallic copper may be placed in the copper (I) ion-containing aqueous solution either continuously or for a limited time. In the latter case, the metallic copper is introduced into the copper (I) ion-containing solution when copper (II) ions are produced in the solution, and remained therein until the copper (II) ions are completely converted into the copper (I) ions.

Furthermore, it is preferable that the contact of the iodine-absorbed fiber matrix with the copper (I) ion-containing aqueous solution in the presence of the metallic copper is carried out in a nitrogen gas atmosphere. The nitrogen gas atmosphere is effective for preventing the oxidation of copper (I) ions into copper (II) ions and the accumulation of copper (II) ions in the copper (I) ion-containing aqueous solution. Therefore, when the above-mentioned contact is carried in the presence of the metallic copper in the nitrogen gas atmosphere, the copper (I) ion-containing solution can be repeatedly used for 30 times or more for the immersion operations of the iodine-absorbed fiber without causing the resultant conductive fiber to be undesirably colored and to exhibit a reduced degree of electric conductivity.

The copper (I) ion-containing aqueous solution may contain any additives, for example, a surface active agent and a swelling agent such as organic solvents for the fiber matrix, unless the additives hinder the objects of the present invention.

The contact of the iodine-absorbed fiber matrix with the copper (I) compound-containing aqueous solution is preferably carried out at a temperature of from 0° to 100° C. This temperature is variable depending on the type and denier of the fiber matrix and composition of the copper (I) compound-containing aqueous solution. For example, in the case of an aliphatic polyamide, polyvinylacetal, cellulose acetate, wool or silk fiber matrix, it is preferable that the contact is carried out at a temperature of from 0° to 40° C. However, in the case of a polyester, whole aromatic polyamide or polyacrylic fiber matrix, the contacting operation is carried out preferably at a temperature of from 30° to 100° C. for a time sufficient to substantially completely convert the iodine absorbed by the fiber matrix to copper iodide. For example, iodine absorbed by a nylon 6 fiber can be substantially completely converted to copper iodide by contacting the iodine-absorbed fiber matrix with an aqueous solution containing 0.2 to 0.3 mole/l of copper (I) chloride at room temperature for about one hour. Also, in the case of a polyethylene terephthalate fiber matrix, the conversion of iodine in the fiber matrix can be completed in about one hour at a temperature of 60° C. However, if the treatment of the iodine absorbed polyethylene terephthalate fiber matrix is carried out at room temperature, the necessary time to completely convert the iodine to copper (I) iodide will be very long, for example, 10 hours or more. Furthermore, when an iodine-absorbed whole aromatic polyamide fiber matrix is immersed in an aqueous solution of 0.2 to 0.3 mole/l of copper (I) compound at a temperature of 90° C., the conversion of iodine in the fiber matrix will be substantially completed in about one hour. However, if the same operation as mentioned above is carried out at room temperature, the necessary time for completing the conversion of iodine will be very long, for example, 10 hours or more.

In the method of the present invention, the contact of iodine with the copper (I) ions may be effected by the absorption of the copper (I) ions by at least the peripheral surface layer of the organic polymeric fiber matrix and, then, by contact of the copper (I) ion-absorbed fiber matrix with an aqueous solution containing iodine. This method can be applied preferably to a polyacrylic fiber matrix. In this case, the same copper (I) compound-containing aqueous solution as that mentioned hereinbefore can be used. Also, the pH of the aqueous solution is preferably adjusted to from 2.0 to 3.0. Furthermore, the same iodine-containing aqueous solution as that mentioned hereinbefore can be applied to a copper (I) ion-absorbed fiber matrix.

After the contacting operation of iodine with copper (I) ions is completed, the resultant fiber is washed with water or a chlorine ion-containing aqueous solution, for example, an aqueous solution of hydrochloric acid or a hydrochloric salt in an amount of from 0.6 to 6 mole/l, at a temperature of from 10° to 100° C. and, then, if necessary, rinsed with water.

The resultant conductive fiber is substantially colorless or pale yellow brown and exhibits an electric resistivity of $1\times10^{12}$ ohm/cm or less under a D.C. voltage of 1 kilovolt after conditoning at a temperature of 20° C. at a relative humidity of 65%.

The conductive fiber of the present invention can be subjected to any conventional textile processing processes, including texturing, scouring, dyeing and finishing processed, without reduction in the electric conductivity thereof. Also, the method of the present invention results in substantially no or negligibly small deterioration in the mechanical properties of the fiber matrix.

The conductive fibers of the present invention are useful for producing antistatic fiber materials, for example, carpets, woven fabrics, knitted fabrics, non-woven fabrics, yarns, ropes, sewing threads or nets. In antistatic fiber materials, the conductive fibers of the present invention may be mixed in an amount of 0.05 to 1% by weight with non-conductive fibers, during any appropriate steps in yarn and fabric manufacturing, for example, yarn spinning, texturing, plying, weaving and knitting processes.

The features and advantages of the present invention are further illustrated by the examples set forth hereinafter, which are not intended to limit the scope of the present invention in any way. In the examples, the electric resistivity of the fiber yarn was determined after conditioning the fiber yarn at a temperature of 20° C. at a relative humidity of 65% for 6 hours, and is represented by an average of the values of resistivity measured at five separate portions of the fiber yarn.

EXAMPLE 1

A polyethylene terephthalate monofilament having a denier of 10 and in an amount of 5 g was wound on a reel into the form of a hank. The hank was immersed in a solution of 600 g of iodine and 400 g of potassium iodide dissolved in one liter of water at a temperature of 70° C. for 30 minutes while stirring the solution and, then, removed from the solution, rinsed with water and air-dried overnight. The above absorbing operation of iodine resulted in an increase of 11.3% in the weight of the hank.

The iodine-absorbed monofilament in the form of a hank on a reel was immersed in a solution of 30 g of copper (I) chloride and 60 g of ammonium chloride dissolved in one liter of water at a temperature of 70° C. for 30 minutes while stirring the solution, washed twice with a solution of 10 ml of commercial concentrated hydrochloric acid dissolved in one liter of water for 10 minutes each time, rinsed with water and, then air-dried.

The resultant conductive polyethylene terephthalate monofilament was pale yellow brown and exhibited a weight of 3.7% above the weight of the original monofilament and an electric resistivity of $3\times10^8$ ohm/cm under a D.C. voltage of 1 kilovolt.

EXAMPLE 2

A polyethylene terephthalate multifilament yarn having a yarn count of 75 denier/24 filaments, a tensile strength of 337.5 g and a weight of 2 g and containing 0.5% by weight of titanium dioxide as a delustering agent, was wound on a reel into the form of a hank. The hank was immersed in the same iodine-containing solution as that described in Example 1 at a temperature of 80° C. for one hour while stirring the solution, rinsed with water and, then, air-dried overnight. The above-mentioned iodine-absorbing operation resulted in an increase of 66% in the weight of the hank.

The resultant iodine-absorbed multifilament yarn in the form of a hank on the reel was immersed in a solution of 20 g of copper (I) chloride and 50 ml of a commercial concentrated hydrochloric acid dissolved in 950 ml of water at the boiling point thereof for 10 minutes, washed and rinsed in the same manner as that described in Example 1 and then, air-dried.

The resulting conductive polyethylene terephthalate multifilament yarn was pale yellow brown and exhibited a weight of 37% above that of the original yarn and a tensile strength of 330.0 g which is approximately the same as that of the original yarn.

The conductive multifilament yarn was unwound from the hank, and a polyethylene terephthalate filament fabric was stitched with the unwound multifilament yarn to prepare a washing specimen. The washing specimen was subjected to a laundering test in which the specimen was washed with an aqueous solution of 0.15% by weight of an anion detergent (\$ "Zabu", trademark, made by Kao Soap Co., Japan) in a home washing machine at a temperature of 40° C. for 5 minutes, rinsed three times with water for 5 minutes for each time, centrifugalized for 5 minutes and, then, air-dried. The laundering operation was repeated 30 times.

The electric resistivity of the multifilament yarn in the specimen was determined under a D.C. voltage of 1 kilovolt before the laundering operation and after 1, 5, 10, 20 and 30 laundering operation(s). The results are indicated in Table 1.

TABLE 1

| Number of laundering operation(s) | 0 | 1 | 5 | 10 | 20 | 30 |
|---|---|---|---|---|---|---|
| Electric resistivity (ohm/cm) | $5\times10^5$ | $9\times10^5$ | $7\times10^5$ | $8\times10^5$ | $10\times10^5$ | $9\times10^5$ |

Table 1 clearly indicates that the resultant conductive multifilament yarn exhibits an excellent laundering durability in electric conductivity.

Also, the copper (I) iodide-forming operation in the polyethylene terephthalate filament matrix in the present example caused substantially no deterioration in the mechanical strength of the filament.

The non-laundered specimen was subjected to an X-ray microanalyzer. As a result, the microscopic photograph shown in FIG. 1 was obtained. This photograph shows the distribution of copper (I) iodide particles in cross sections of the polyethylene terephthalate filaments. It is clear that the copper (I) iodide particles are distributed in a width of about 6 microns from the peripheral surface of the filament.

EXAMPLE 3

The same operations as those described in Example 2 were applied to 2 g of a polyethylene terephthalate monofilament having a denier of 10 and a tensile strength of 60 g, except that the iodine-absorbing operation was carried out for 2 hours. The resultant conductive filament was pale yellow brown and exhibited a weight of 22% above that of the original filament and a tensile strength of 59 g. The same laundering test as that described in Example 2 was applied to the resultant conductive filament. The results are shown in Table 2.

TABLE 2

| Number of laundering operation(s) | 0 | 1 | 5 | 10 | 20 | 30 |
|---|---|---|---|---|---|---|
| Electric resistivity (ohm/cm) | $5\times10^6$ | $9\times10^6$ | $5\times10^6$ | $9\times10^6$ | $7\times10^6$ | $9\times10^6$ |

EXAMPLE 4

The same procedures as those mentioned in Example 2 were applied to 2 g of a polyethylene terephthalate monofilament having a denier of 30 and a tensile strength of 153 g, except that the iodine-absorbing time was 3 hours.

The resultant conductive polyethylene terephthalate monofilament was pale yellow brown and exhibited a tensile strength of 153 g and a weight of 22% above that of original monofilament. The monofilament was subjected to the same laundering test as that mentioned in Example 2. The results are indicated in Table 3.

TABLE 3

| Number of laundering operation | 0 | 1 | 5 | 10 | 20 | 30 |
|---|---|---|---|---|---|---|
| Electric resistivity (ohm/cm) | $1\times10^5$ | $6\times10^5$ | $9\times10^5$ | $20\times10^5$ | $18\times10^5$ | $15\times10^5$ |

EXAMPLE 5

A polyethylene terephthalate multifilament yarn having a yarn count of 75 denier/24 filaments and containing 0.5% by weight of titanium dioxide as a delustering agent, was knitted by using a circular knitting machine into a circular knitted fabric. 50 g of the knitted fabric was placed in a treating vessel with a stirrer and wound and fixed around stirring wings and, then, treated with a solution of 600 g of iodine and 400 g of potassium iodide dissolved in one liter of water at a temperature of 70° C. for one hour while rotating the stirring wings at a speed of 30 r.p.m. After the iodine-absorbing operation was completed, the iodine solution was removed from the vessel and the knitted fabric on the stirring wings was rinsed with water and air-dried overnight. This operation resulted in an increase of 80% in the weight of the fabric.

The treating vessel was charged with a solution of 120 g of copper (I) iodide and 280 g of ammonium chloride dissolved in 4 liters of water, and the stirring wings on which the knitted fabric was fixed was rotated at a speed of 30 r.p.m. in the solution at a temperature of 55° C. Thereafter, the knitted fabric was removed from the stirring wings, immersed in a solution of 4 ml of Scourol 400 (trademark of a non-ionic detergent made by KAO-ATRAS Co., Japan) dissolved in 2 liters of water at the boiling point thereof for 30 minutes, washed with a solution of 10 ml of commercial concentrated hydrochloric acid dissolved in 2 liters of water at room temperature for 10 minutes, washed with a solution of 20 g of ammonium chloride dissolved in 2 liters of water at room temperature for 10 minutes, rinsed with water and, then, air-dried. The dried knitted fabric was unknitted, and the resultant multifilament yarn was wound on a bobbin. The resultant multifilament yarn was colorless and exhibited a weight of 83% above that of the original yarn and an electric resistivity of $4\times10^5$ ohm/cm under a D.C. voltage of 1 kilovolt.

EXAMPLE 6

The same procedures as those described in Example 5 were applied to 30 g of polyethylene terephthalate staple fibers each of which had a denier of 1.5 and a length of 38 mm and contained 0.5% by weight of titanium dioxide as a delustering agent and which were loosely packed in a cylindrical bag made of fabric, the cylindrical bag containing the staple fibers being wound and fixed around stirring wings of the stirrer.

The resultant conductive staple fibers exhibited a weight of 65% above that of the original staple fibers and were colorless. The individual staple fibers exhibited an electric resistivity of $2\times10^7$ ohm/cm under a D.C. voltage of 1 kilovolt.

EXAMPLE 7

5 g of nylon 6 monofilament containing 0.5% by weight of titanium dioxide as a delustering agent and having a denier of 20 and a tensile strength of 101 g were wound on a reel to form a hank. The monofilament on the reel was immersed in a solution of 100 g of iodine and 150 g of potassium iodide dissolved in one liter of water at room temperature for 30 minutes while being stirred, rinsed with water and, then, air-dried overnight. This iodine-absorbing operation resulted in an increase of 76% in the weight of the monofilament.

The resultant iodine-absorbed nylon 6 monofilament on the reel was immersed in a solution of 10 g of copper (I) chloride and 50 ml of a commercial concentrated hydrochloric acid dissolved in 950 ml of water at room temperature for one hour while being stirred, washed twice with a solution of 10 ml of the concentrated hydrochloric acid dissolved in one liter for 10 minutes for each time, rinsed with water and, then, air-dried.

The resultant conductive nylon 6 monofilament was pale yellow brown and exhibited a weight of 99% above the original weight of the nylon monofilament and a tensile strength of 86 g which is lower than the original strength of the monofilament, but sufficient for practical use. Also, the resultant conductive nylon 6 monofilament had an electric resistivity of $5\times10^5$ ohm/cm under a D.C. voltage of 1 kilovolt.

The distribution of the copper (I) iodide crystals formed in the nylon 6 filament matric is indicated in FIG. 2 which is a microscopic photograph (×500) taken by using an X-ray microanalyzer. This photograph shows that the copper (I) iodide crystals are uniformly distributed in the entire body of the nylon 6 filament.

EXAMPLE 8

A hank in an amount of 5 g was provided by winding on a reel a spun yarn having a denier of 368 and consisting of whole aromatic polyamide fibers which had been produced from poly-m-phenylene isophthalamide and which had a denier of 2 and a length of 51 mm.

The hank on the reel was immersed in a solution of 300 g of iodine and 200 g of potassium iodide dissolved in one liter of water at a temperature of 80° C. for one hour while being stirred, and, then, rinsed with water. This iodine-absorbing operation resulted in an increase in the weight of the hank which corresponds to 25% of the original weight of the hank.

The iodine-absorbed hank was immersed in a solution of 20 g of copper (I) chloride and 40 g of ammonium chloride dissolved in one liter of water, in which solution 10 g of the metallic copper powder were placed, and the resultant treating system was heated to a temperature of 100° C. over 2 hours while being stirred. Thereafter, the hank was washed twice with a solution of 10 ml of commercial concentrated hydrochloric acid dissolved in one liter of water for 10 minutes each time, rinsed with water and, then, air-dried. The resultant conductive whole aromatic polyamide fiber spun yarn had a weight corresponding to 120% of the original weight of the hank and an electric resistivity of $1\times10^{10}$ ohm/cm under a D.C. voltage of 1 kilovolt. Also, it was found that the above procedures resulted in no deterioration in the mechanical strength of the yarn.

EXAMPLE 9

A hank in an amount of 5 g was prepared by winding on a reel a sewing thread consisting of polyvinyl acetal multifilaments and having a denier of 482. The hank was immersed in a solution of 30 g of iodine and 20 g of potassium chloride dissolved in one liter of water at room temperature for one hour and, then, rinsed with water. By this iodine-absorbing operation, the hank absorbed iodine in an amount corresponding to 220% of the original weight of the hank.

The iodine-absorbed hank was immersed in a solution of 20 g of copper (I) chloride and 40 g of ammonium chloride dissolved in one liter of water, in which solution 10 g of metallic copper powder were placed, at room temperature for 2 hours while being stirred. The hank was washed twice with a solution of 10 ml of commercial concentrated hydrochloric acid dissolved in one liter for 10 minutes each time, rinsed with water and, then, air-dried.

The resultant hank had a weight corresponding to 229% of the original weight of the hank. The individual sewing thread had an electric resistivity of $4\times10^3$ ohm/cm under a D.C. voltage of 1 kilovolt.

EXAMPLE 10

5 g of 236 denier spun yarn consisting of polyacrylonitrile staple fibers each having a denier of 2 and a length of 51 mm, were wound on a reel to form a hank. The hank was subjected to the same procedures as those described in Example 9, except that the immersion time of the hank in the iodine-containing solution was 20 minutes and the immersion temperature of the iodine-absorbed hank in the copper (I) chloride-containing solution was 80° C.

The resultant conductive yarn exhibited a weight corresponding to 299% of the original weight of the yarn and an electric resistivity of $4\times10^3$ ohm/cm under a D.C. voltage of 1 kilovolt.

EXAMPLE 11

A hank in an amount of 5 g was prepared by winding on a reel a cellulose acetate multifilament yarn having a yarn count of 100 denier/25 filaments. The hank was subjected to the same procedures as those described in Example 9, except that the immersing time of the iodine-absorbed hank in the copper (I) chloride solution was one hour. These procedures resulted in an increase in the weight of the hank which corresponds to 114% of the original weight of the hank. The resultant conductive cellulose acetate yarn exhibited an electric resistivity of $4\times10^5$ ohm/cm under a D.C. voltage of 1 kilovolt.

EXAMPLE 12

5 g of home hand knitting wool yarn having a denier of 3890 was subjected to the same procedures as those described in Example 9. The procedures caused the weight of the wool yarn to increase in an amount corresponding to 114% of the original weight of the yarn. The resultant conductive wool yarn exhibited an electric resistivity of $1\times10^2$ ohm/cm under a D.C. voltage of 1 kilovolt.

EXAMPLE 13

The same procedures as those described in Example 9 were applied to 5 g of a home sewing silk thread having a denier of 314. The procedures resulted in an increase in the weight of the silk thread which corresponds to 123% of the original weight of the silk thread. The resultant conductive silk thread had an electric resistivity of $2\times10^3$ ohm/cm under a D.C. voltage of one kilovolt.

EXAMPLE 14

A circular knitted fabric in an amount of 100 g was produced from a polyethylene terephthalate multifilament yarn having a yarn count of 75 denier/24 filaments.

A treating vessel with a stirrer was charged with a solution of 4,600 g of iodine and 5,000 g of potassium iodide dissolved in 10 liters of water, and the stirring wings of the stirrer were loosely covered with the knitted fabric. The stirring wings were rotated at a speed of 30 r.p.m in the iodine-containing solution for one hour at a temperature of 70° C. The resultant iodine-absorbed knitted fabric was rinsed with water and air-dried overnight. This iodine-absorbing operation caused the weight of the knitted fabric to increase in an amount of 35 g which correspond to 35% of the original weight of the knitted fabric.

The iodine-absorbed knitted fabric was cut into 20 pieces of equal size.

One of the knitted fabric pieces was loosely wound and fixed on the stirring wings of the stirrer, and the stirrer was rotated at a speed of 30 r.p.m in a solution of 40 g of copper (I) chloride and 85 g of ammonium chloride dissolved in one liter of water at a temperature of 55° C. for 60 minutes. Before the knitted fabric piece was immersed in the copper (I) chloride-containing solution, a metallic copper wire having a peripheral surface area of 600 $cm^2$ was placed in the solution for 60 minutes in order to reduce the copper (II) ions to copper (I) ions.

The knitted fabric piece was removed from the solution, immersed in a solution of 2 ml of Scourol 400 (trademark of non-ionic detergent made by KAO-ATRAS Co., Japan) and 20 g of ammonium chloride dissolved in one liter of boiling water for 30 minutes, rinsed with water and, then, air-dried. The resultant knitted fabric piece was unknitted and the resultant multifilament yarn was wound on a bobbin.

Another one of the knitted fabric pieces was subjected to the same operations as those mentioned above, except that the remaining copper (I) chloride-containing solution from the previous operations was used.

The same operation as those mentioned above were applied successively to each one of the remaining 18 knitted fabric pieces by using the remaining copper (I) chloride-containing solution from the previous operations. In each application of the operations, the metallic copper wire was placed in the copper (I) chloride-containing solution.

During the entire period of the above-mentioned procedures, the copper (I) chloride-containing solution was continuously colorless while a thin green membrane was produced on the surface of the solution in the third application of the operations. However, the green membrane did not grow in the fourth application and thereafter.

In each application of the operations, the resultant conductive polyethylene terephthalate multifilament yarn was pale yellow brown and exhibited an increase in weight corresponding to from 24 to 28% of the weight of the original multifilament yarn and an electric resistivity of from $5\times10^7$ to $3\times10^8$ ohm/cm under a D.C. voltage of one kilovolt.

For the purpose of comparison, the same procedures as those mentioned above were repeated except that no metallic copper wire was placed in the copper (I) chloride-containing solution. The results are shown in Table 4.

TABLE 4

| | | Resultant conductive yarn | | |
|---|---|---|---|---|
| Application No. | Hue of CuCl solution | Increase in weight (%) | Electric resistivity (ohm/cm) | Hue |
| 1 | Pale green | 27 | $8\times10^7$ | Pale yellow |
| 2 | Green | 17 | $5\times10^9$ | Pale green |
| 3 | Dark green | 13 | $9\times10^{10}$ | Dark green |
| 4 | " | 4 | $>1\times10^{12}$ | " |
| 5 | " | 3 | $>1\times10^{12}$ | " |

It was observed that after the first application, a green membrane was produced on the surface of the copper (I) chloride-containing solution and the membrane grey with an increase in the number of applications.

Table 4 clearly indicates that the absence of the metallic copper in the copper (I) chloride-containing solution resulted in the build up of copper (II) ions.

EXAMPLE 15

The same procedures as those described in Example 14 were carried out, except that a copper wire having a peripheral surface area of 600 $cm^2$ was continuously placed in the copper (I) chloride-containing solution throughout the entire procedures.

It was found that throughout the entire period of the procedures, the copper (I) chloride-containing solution remained colorless, except in the initial stage of each immersion operation of the iodine-absorbed knitted fabric piece when the copper (I) chloride-containing solution was colored pale green and, then, about 10 minutes after the coloration, the solution become colorless. Also, it was found that before the third application of the immersion operation, a small amount of thin green membrane was formed on the surface of the copper (I) chloride-containing solution and the membrane did not grow in the third operation and thereafter.

In the first application, the resultant conductive multifilament yarn was pale yellow and had an increase in weight corresponding to 26% of the original weight of the yarn and an electric resistivity of $7\times10^7$ ohm/cm under a D.C. voltage of one kilovolt.

In the second application, the resultant conductive multifilament yarn was pale yellow and exhibited an increase in weight corresponding to 27% of the original weight of the yarn and an electric resistivity of $3\times10^7$ ohm/cm under a D.C. voltage of one kilovolt.

Also, in each of the applications from the third to the twentieth, the resultant conductive multifilament yarn was pale yellow and exhibited an increase in weight corresponding to from 26 to 28% of the original weight of the yarn and an electric resistivity of from $6\times10^7$ to $2\times10^8$ ohm/cm under a D.C. voltage of one kilovolt.

EXAMPLE 16

The same procedures as those described in Example 14 were carried out except that the immersion operation of the iodine-absorbed knitted fabric piece in the copper (I) chloride-containing solution was carried out in a nitrogen gas atmosphere, and the application of the immersion operation was repeated successively 35 times by using the remaining copper (I) chloride-containing solution from the previous application each time.

It was found that during the entire period of the procedures, the copper (I) chloride-containing solution remained colorless and, in each application of the immersion operation, the resultant conductive multifilament yarn was pale yellow and exhibited an increase in weight in an amount corresponding to from 24 to 28% of the original weight of the yarn and an electric resistivity of from $5\times10^7$ to $3\times10^8$ ohm/cm under a D.C. voltage of one kilovolt.

Also, it was observed that during the entire period of the procedures, no green membrane was formed on the surface of the copper (I) chloride-containing solution.

For the purpose of comparison, the same procedures as those described above were carried out, except that no copper wire was placed in the copper (I) chloride-containing solution. The results are shown in Table 5.

TABLE 5

| | | Resultant conductive yarn | | |
|---|---|---|---|---|
| Application No. | Hue of CuCl solution | Increase in weight (%) | Electric resistivity (ohm/cm) | Hue |
| 1 | Pale green | 29 | $6\times10^7$ | Pale yellow |
| 2 | Green | 24 | $3\times10^8$ | " |
| 3 | " | 20 | $8\times10^8$ | Pale green |
| 4 | " | 17 | $7\times10^9$ | " |
| 5 | Dark green | 14 | $4\times10^{10}$ | Green |
| 6 | " | 8 | $>1\times10^{12}$ | Dark green |
| 7 | " | 5 | $>1\times10^{12}$ | " |

It was found that before the fourth application of the immersion operation, a green membrane was produced on the surface of the copper (I) chloride-containing solution and, then, the amount of the membrane increased with an increased in the number of the applications of the immersion operation.

EXAMPLE 17

The same procedures as those described in Example 16 were carried out, except that the copper wire was continuously placed in the copper (I) chloride-containing solution throughout the entire procedures.

It was observed that throughout the entire period of the procedures, the copper (I) chloride-containing solution was colorless and no green membrane and precipitation were formed on or in the solution respectively.

In the first application of the immersion operation, the resultant conductive multifilament yarn was pale yellow and exhibited an increase in weight in an amount corresponding to 27% of the original weight of the yarn and an electric resistivity of $4\times10^7$ ohm/cm under a D.C. voltage of one kilovolt.

The second application of the immersion operation resulted in a conductive multifilament yarn which was pale yellow and exhibited an increase in weight in an amount corresponding to 28% of the original weight of the yarn and an electric resistivity of $3\times10^7$ ohm/cm under a D.C. voltage of one kilovolt.

Also, in each application from the third to the thirty fifth, the resultant conductive multifilament yarn was pale yellow and exhibited an increase in weight in an amount corresponding to from 25 to 28% of the original weight of the yarn and an electric resistivity of from $5\times10^7$ to $4\times10^8$ ohm/cm under a D.C. voltage of one kilovolt.

EXAMPLE 18

The same procedures as those described in Example 17 were carried out except that the immersion operation of the iodine-absorbed knitted fabric piece was carried out in an ambient atmosphere in place of the nitrogen gas atmosphere, and the immersion operation was applied 25 times.

It was observed that throughout the entire period of the procedures, the copper (I) chloride-containing solution was colorless, except in the initial stage of each application of the immersion operation when the hue of the copper (I) chloride-containing solution was pale green. However, about 10 times after this stage, the solution became colorless. Also, it was found that before the third application of the immersion operation, a small amount of a green membrane was formed on the surface of the solution but the membrane did not grow in the third application and thereafter.

EXAMPLE 19

A side-by-side type composite multifilament yarn, having a yarn count of 75 denier/24 filaments, was prepared from a first component consisting of polyethylene terephthalate containing 0.5% by weight of titanium dioxide as a delustering agent, and a second component consisting of a copolyester of a dicarboxylic acid moiety consisting of 85 molar % of terephthalic acid and 15 molar % of adipic acid and a glycol moiety consisting of ethylene glycol. In an individual composite filament, the ratio in cross-sectional area of the first component to the second component was 5:1.

The abovementioned composite multifilament yarn was knitted by using a circular knitting machine into a circular knitted fabric. 10 g of the knitted fabric was placed in a treating vessel with a stirrer, and loosely wound and fixed around stirring wings, and then, treated with a solution of 600 g of iodine and 400 g of potassium iodide dissolved in one liter of water, at a temperature of 40° C., for one hour, while rotating the stirring wings at a speed of 30 r.p.m. After the iodine-absorbing operation was completed, the iodine solution was removed from the treating vessel and the knitted fabric on the stirring wings was rinsed with water and air-dried overnight. This operation resulted in an increase of 12% in the weight of the knitted fabric.

The treating vessel was filled with a solution of 120 g of copper (I) iodide and 400 g of ammonium chloride dissolved in 4 liters of water, and the stirring wings on which the knitted fabric was fixed was rotated at a speed of 30 r.p.m in the copper (I) chloride solution, at a temperature of 40° C., for 60 minutes. Thereafter, the knitted fabric was removed from the stirring wings, immersed in a solution of 4 ml of Scourol 400 dissolved in 2 liters of water, at the boiling point thereof, for 30 minutes, washed twice with a solution of 40 g of ammonium chloride dissolved in 2 liters of water, at a boiling point thereof, for 10 minutes each time, rinsed with water and, then, air-dried. The dried knitted fabric was unknitted, and the resultant composite multifilament yarn was wound on a bobbin. The composite multifilament yarn was colorless (white) and exhibited a weights of 4.1% above that of the original yarn. The individual composite filaments exhibited an electric resistivity of $5\times10^8$ ohm/cm per filament under a D.C. voltage of 1 kilovolt.

It was found that almost of the copper (I) iodide particles deposited in the filament were located in the second component of the filament.

What is claimed is:

1. An electrically conductive fiber comprising an organic polymeric fiber matrix and copper (I) iodide which is located in the inside of at least the peripheral surface layer of said organic polymeric fiber matrix and which is in an amount sufficient to cause the electric resistivity of the conductive fiber under a D.C. voltage of 1 K.V. at a temperature of 20° C. and at a relative humidity of 65% to be $1\times10^{12}$ ohm/cm or less.

2. An electrically conductive fiber as claimed in claim 1, wherein the amount of copper (I) iodide is at least 2% based on the weight of said organic polymeric fiber matrix.

3. An electrically conductive fiber as claimed in claim 2, wherein the amount of copper (I) iodide is in a range of from 2 to 250% based on the weight of said organic polymeric fiber matrix.

4. An electrically conductive fiber as claimed in claim 1, wherein said organic polymeric fiber matrix is selected from the group consisting of polyester, aliphatic polyamide, whole aromatic polyamide, polyacrylic, vinyl compound polymer, cellulose diacetate and cellulose triacetate fibers, animal hair fibers and silk.

5. A method for producing an electrically conductive fiber which comprises an organic polymeric fiber matrix and copper (I) iodide contained within at least the peripheral surface layer of said organic polymeric fiber matrix, and which exhibits an electric resistivity of $1\times10^{12}$ ohm/cm or less under a D.C. voltage of 1 K.V. at a temperature of 20° C. and at a relative humidity of 65%, said method comprising bringing iodine into contact with copper (I) ions in the inside of at least the peripheral surface layer of said organic polymeric fiber matrix and depositing the resultant copper (I) iodide therein in an amount sufficient to result in the abovementioned level of electric resistivity of the resultant conductive fiber.

6. A method as claimed in claim 5, wherein said contact of iodine with said copper (I) ions is effected by the absorption of iodine by at least the peripheral surface layer of said organic polymeric fiber matrix and, then, by contact of said iodine-absorbed fiber matrix with an aqueous solution containing a copper (I) compound.

7. A method as claimed in claim 6, wherein said absorption operation is carried out by bringing said organic polymeric fiber matrix into contact with an aqueous solution containing iodine and an iodine-dissolving promoter.

8. A method as claimed in claim 6, wherein said copper (I) compound is selected from the group consisting of copper (I) chloride, copper (I) bromide and copper (I) sulfite.

9. A method as claimed in claim 6, wherein said aqueous solution of said copper (I) compound is prepared by reducing a copper (II) compound dissolved in water with a reducing agent.

10. A method as claimed in claim 6, wherein said contact of said iodine-absorbed fiber matrix with said copper (I) compound aqueous solution is carried out in the presence of metallic copper.

11. A method as claimed in claim 10, wherein said contact is carried out in a nitrogen gas atmosphere.

12. A method as claimed in claim 5, wherein said contact of iodine with said copper (I) ions is effected by the absorption of said copper (I) ions by at least the peripheral surface layer of said organic polymeric fiber matrix and, then, by contact of said copper (I) ion-absorbed fiber matrix, with an aqueous solution containing iodine.

* * * * *

UNITED STATES PATENT OFFICE
CERTIFICATE OF CORRECTION

Patent No. 4,267,233 Dated May 12, 1981

Inventor(s) Hiroaki Tanaka et al.

It is certified that error appears in the above-identified patent and that said Letters Patent are hereby corrected as shown below:

Column 2, line 13: "The" should be --This--.

Column 4, line 17: delete this line.

Column 5, line 8: "the" should be --any--.

Column 15, line 1: "grey" should be --grew--.

Column 16, line 18: "increased" should be --increase--.

Column 17, line 43: "weights" should be --weight--.

line 48: replace "almost" by --most--.

Signed and Sealed this

First Day of December 1981

[SEAL]

Attest:

GERALD J. MOSSINGHOFF

Attesting Officer

Commissioner of Patents and Trademarks